US006124557A

United States Patent [19]

Kang

[11] Patent Number: 6,124,557

[45] **Date of Patent: *Sep. 26, 2000**

[54] MULTI-POSITION SWITCHING ACTUATOR FOR SWITCH GEAR

[75] Inventor: Kyeong Rok Kang, Cheongju, Rep. of Korea

[73] Assignee: LG Industrial Systems Co., Ltd., Seoul, Rep. of Korea

[ * ] Notice: This patent is subject to a terminal disclaimer.

[21] Appl. No.: 08/997,563

[22] Filed: Dec. 23, 1997

[51] Int. Cl.[7] ..... H01H 5/04

[52] U.S. Cl. ..... 200/400; 200/11 R; 200/470

[58] Field of Search ..... 200/400, 401, 200/424, 17 B, 11 R, 470, 468, 564, 325, 327; 218/154

[56] References Cited

U.S. PATENT DOCUMENTS

| | | | |
|---|---|---|---|
| 5,034,575 | 7/1991 | Stewart | 200/11 R |
| 5,113,056 | 5/1992 | Kuhn | 200/400 |
| 5,224,590 | 7/1993 | Milianowicz et al. | 200/400 |
| 5,226,528 | 7/1993 | Schaffer et al. | 200/400 |
| 5,274,206 | 12/1993 | Milianowicz | 200/400 |
| 5,276,288 | 1/1994 | Erickson et al. | 200/400 |
| 5,326,944 | 7/1994 | Garcia | 200/11 R |
| 5,504,293 | 4/1996 | Rogers et al. | 218/154 |

*Primary Examiner*—Renee Luebke

[57] ABSTRACT

A multi-position switching actuator for a switch gear includes a control handle unit including a control protrusion and an insertion recess, a rotation member disposed at a portion spaced from a rear portion of the control handle unit and rotated by a rotation of the control handle unit, a front plate disposed between the control handle unit and the rotation member, a latch releasing member engaged to the rear surface of the rotation member, a latch driving member engaged to the latch releasing member, a location fixing member connected to the latch driving member and limiting a rotation of the latch driving member by a predetermined angle, an elastic member disposed between the latch releasing member and the latch driving member for thereby generating an instant rotation of the latch driving member, and a central shaft for being inserted from a rear portion of the latch driving member toward the front of the multi-position switching actuator. The actuator appropriately switches a contact point to another and carry out a 3-position (open-close-earth) control, a four-position (open-close-open-close) control and a multi-position control by employing a single actuator.

21 Claims, 8 Drawing Sheets

MULTI-POSITION SWITCHING ACTUATOR FOR SWITCH GEAR

BACKGROUND OF THE INVENTION

1. Field of the Invention

The present invention relates to a switch gear, and more particularly to an improved multi-position switching actuator for a switch gear which makes it possible to appropriately switch a contact point to another and carry out a 3-position (open-close-earth) control, and a multi-position control by employing a single actuator.

2. Description of the Background Art

In general, a switch gear employs a power distribution system including an overhead power distributing line and a subterranean power distributing line, and allows an electrical power supplied from a first substation to apply to power receiving devices for a plurality of power consumers. Such a switch gear may be used to partition and to branch power lines for the subterranean power lines.

As shown in FIG. 1, the switch gear according to a conventional art includes: a main body 1; four switching actuators 100 respectively disposed at upper portions of the main body 1 and for making a movable contact move; and a plurality of three-phase main bushes 2 disposed at lower portions of the switching actuators 100 and for receiving power from a first substation and supplying or interrupting the power to power receiving facilities of respective electric loads of respective power consumers under the control of the switching actuators 100.

In the conventional switch gear, the switching actuator 100 actuates respective movable contacts of a switching mechanism, the power received from one of the main bushes 2 depending upon its demand, thereby supplying the power to another of the main bushes 2 or to respective power consumers, or interrupting the power supply.

The conventional switching actuator for a switch gear will now be described.

As shown in FIGS. 2–5B, the switching actuator for a switch gear known as a toggle type control device, which carries out a two-position contact switching, includes: a base plate 120; a driving shaft unit 130 disposed at a central portion behind the base plate 120 and having a driving shaft 132 extruded from a marginal end surface thereof; a subordinate driving shaft link unit 140 having a via hole 142 formed through an end portion thereof so that the driving shaft 132 is provided through the via hole 142 for thereby being coupled with the driving shaft unit 130; a spring 150 a left end portion 151 of which is hooked on a protrusion 134 extended backwardly from another end portion of the driving shaft unit 130, and another end portion 15:2 of which is hooked on a protrusion 144 extended from an end portion of the subordinate driving shaft link unit 140; a center shaft unit 160 disposed below a portion at which the driving shaft unit 130 and the subordinate driving shaft link unit 140 are coupled with each other, and an end portion of which is movably engaged to a link 143 which is also movably engaged to the subordinate driving shaft link unit 140; and a control handle 110 disposed at a front portion of the base plate 120 and having an insertion protrusion (not shown) formed at a center thereof so as to be engaged to the driving shaft 132.

The base plate 120 includes a via hole (not shown) formed in a center thereof, and arc openings 121 which are spaced from the via hole (not shown) and are formed on opposite sides of a driving shaft 132.

As shown in FIGS. 4A and 4B, the driving shaft unit 130 includes: a stable arm 131; the driving shaft 132 extended from an end portion of the front surface of the stable arm 131, wherein an insertion opening (not shown) is formed in an end portion of the driving shaft 132 so that a portion extended from the control handle 110 is engaged into the insertion opening (not shown); a limit protrusion 133 extended from an eccentric portion of the front surface of the stable arm 131 for thereby limiting a rotation of the driving shaft unit 130; and the hook protrusion 134 extended from an end portion of a rear surface of the stable arm 131 so as to be rotated in correspondence to the rotation of the driving shaft 132.

In the above driving shaft unit 130, the hook protrusion 134 becomes hooked on the one end portion 151 of the spring 150, and the limit protrusion 133 becomes inserted into the corresponding arc opening 121 formed in the base plate 120, so that the rotation of the driving shaft unit 130 is limited accordingly.

As shown in FIGS. 5A and 5B, the subordinate driving shaft link unit 140 includes: a pair of stable pads 141; a link 143 provided between the pair of stable pads 141; a via hole 142 formed in end portions of the stable pads 141 and for receiving the driving shaft 132 therethrough; an hook protrusion 144 extended from another end portion of a rear surface of the stable pads 141 and being moved by an elastic restoration force of the spring 150; and a limit protrusion 145 extended from a portion of a front surface of the stable pads 141.

Also, in the central portions of the stable pads 141 there is formed an insertion hole which receives an insertion protrusion 146 therethrough.

In the subordinate driving shaft link unit 140, the hook protrusion 144 is hooked on the other end portion 152 of the spring 150, and the limit protrusion 145 is inserted into the arc opening 121 formed in the base plate 120 for thereby limiting the rotation of the subordinate driving shaft link unit 140.

The link 143 includes an insertion opening 143*a* formed in each end portion thereof. The insertion protrusion 146 of the stable pads 141 and an insertion protrusion 163 extended from a portion of the central shaft unit 160 are correspondingly inserted into the insertion openings 143*a*, whereby the rotation force of the subordinate driving shaft link unit 140 becomes transferred to the central shaft unit 160.

The central shaft unit 160, as shown in FIG. 2, includes: a center shaft 162; and a stable arm 161 having an insertion protrusion 163 extended from an end portion thereof, wherein the other end of the stable arm 161 is connected to the center shaft 162 and the insertion protrusion 163 is inserted into the insertion opening 143*a* formed in the link 143.

The operational steps of the conventional contact switching actuator for a switch gear according to the manual control method will now be described with reference to the accompanying drawings.

As shown in FIGS. 6 through 8, when the control handle 110 is gradually rotated in a clockwise direction, the rotational force of the control handle 110 is transferred to the driving shaft unit 130 through the driving shaft 132 connected thereto, and accordingly the driving shaft unit 130 gradually makes a clockwise rotation.

When the driving shaft unit 130 makes its rotation, the hook protrusion 134 formed at the end portion of the rear surface of the driving shaft unit 130 makes its gradual clockwise rotation, thereby causing tension at the spring 150 which is hooked on the hook protrusion 134.

Also, when the limit protrusion 133 of the driving shaft unit 130 is reaches an end portion of the arc opening 121 of the base plate 120 after a continuous rotation of the driving shaft unit 130, the hook protrusion 145 extended from the end portion of the rear surface of the subordinate driving shaft link unit 140 instantly makes an anticlockwise rotation in accordance with an elastic restoration force of the spring 150, whereby the subordinate driving shaft unit 140 instantly makes its counter-clockwise rotation.

When the subordinate driving shaft link unit 140 makes its instant anticlockwise direction, the central shaft 162 which is connected to the link 143makes also its counter-clockwise rotation, thereby switching a contact coupled to the central shaft 162 to another.

However, although such two-position (open-close) switching operations of the two-position switching actuator for a switch gear may be completely carried out, more than two switching actuators are required in order to satisfy a variety of requirements for such as a 3-position (open-close-earth) contact or a 4-position (open-close-open-close) contact switching.

Consequently, the conventional two-position contact switching actuator results in an inconvenience in its generation as well as causes difficulty in its production as the size of its product becomes larger.

SUMMARY OF THE INVENTION

Accordingly, it is an object of the present invention to provide a multi-position switching actuator for a switch gear which makes it possible to appropriately switch a contact point to another contact point and carry out a 3-position (open-close-earth) switching, and a multi-position switching by employing a single actuator.

To achieve the above-described and other objects, there is provided a multi-position switching actuator for a switch gear according to the present invention, which includes a control handle unit including a control protrusion extended from a rear side surface thereof and a insertion recess formed in a central rear surface thereof, a rotation member disposed at a portion spaced from a rear portion of the control handle unit and rotated in accordance with a rotation of the control handle unit, a front plate disposed between the control handle unit and the rotation member for thereby limiting a rotation of the control handle unit, a latch releasing member fixedly engaged to the rear surface of the rotation member and rotated in correspondence to the rotation member, a latch driving member fixedly engaged to the latch releasing member and rotated in correspondence to a rotation of the latch releasing member, a location fixing member connected to the latch driving member and limiting a rotation of the latch driving member by a predetermined angle, an elastic member disposed between the latch releasing member and the latch driving member for thereby generating an instant rotation of the latch driving member, and a central shaft for being inserted from a rear portion of the latch driving member toward the front of the multi-position switching actuator.

The objects and advantages of the present invention will become more readily apparent from the detailed description given hereinafter. However, it should be understood that the detailed description and specific examples, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
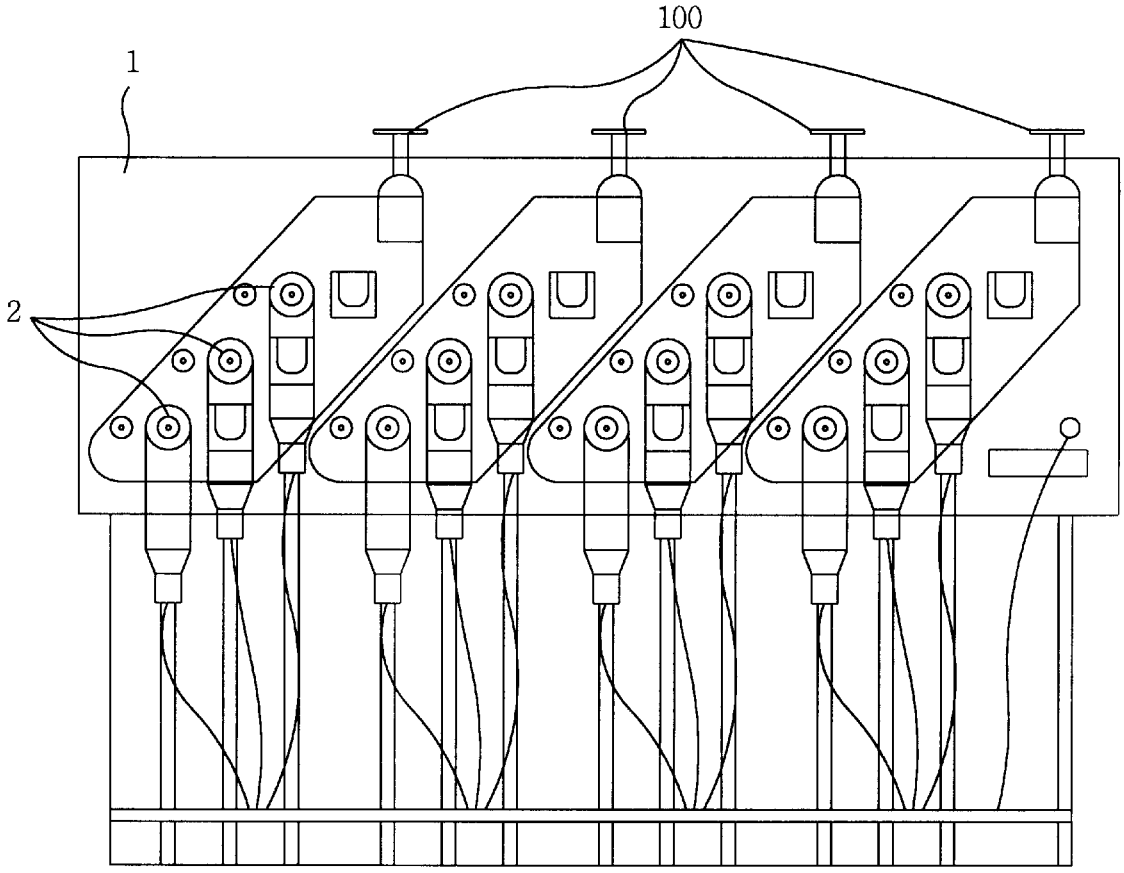
FIG. 1 CONVENTIONAL ART
FIG. 1 is a front view illustrating a switch gear according to a conventional art.
Figure 2:
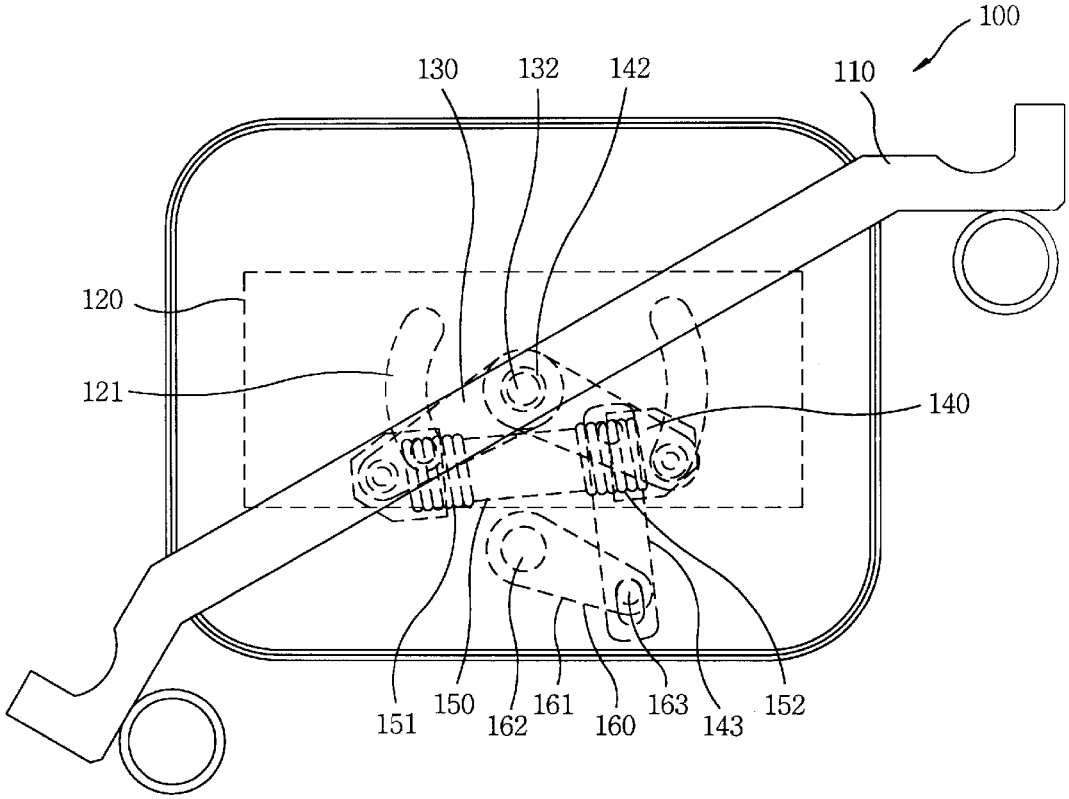
FIG. 2 CONVENTIONAL ART
FIG. 2 is a front view illustrating a two-position switching actuator for a switch gear according to the conventional art.
Figure 3:
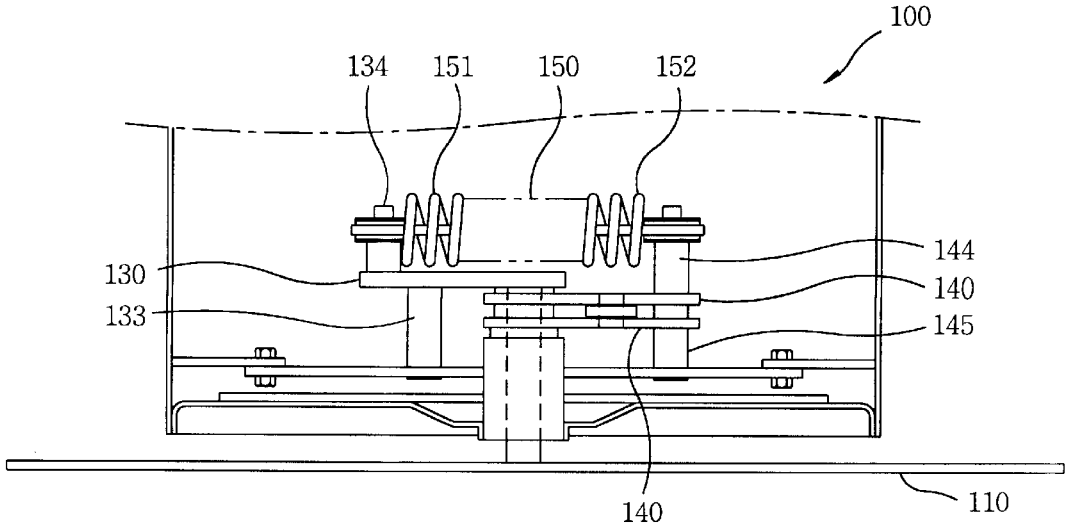
FIG. 3 CONVENTIONAL ART
FIG. 3 is a plan view illustrating a two-position switching actuator for a switch gear according to the conventional art.
Figure 4A:
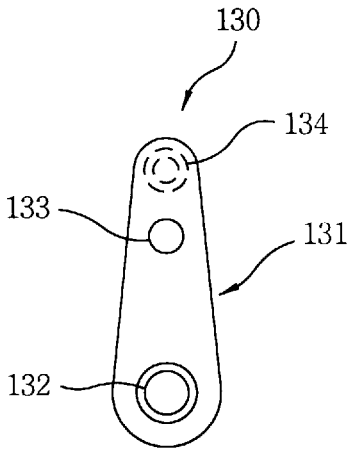
FIG.4A CONVENTIONAL ART
FIG. 4A is a front view illustrating a driving shaft unit of the two-position switching actuator according to the conventional art.
Figure 4B:
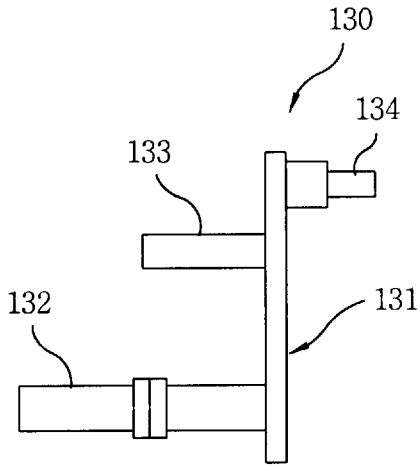
FIG.4B CONVENTIONAL ART
FIG. 4B is a side view illustrating a driving shaft unit of the two-position switching actuator according to the conventional art.
Figure 5A:
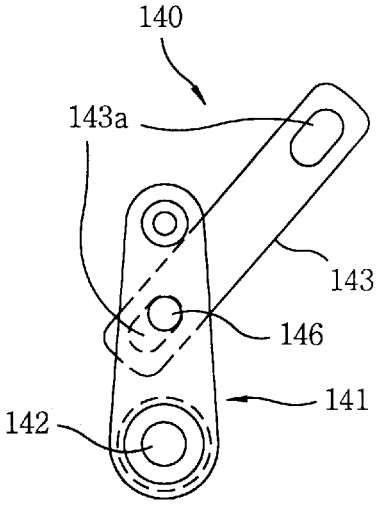
FIG.5A CONVENTIONAL ART
FIG. 5A is a front view illustrating a subordinate driving shaft link unit of the two-position switching actuator according to the conventional art.
Figure 5B:
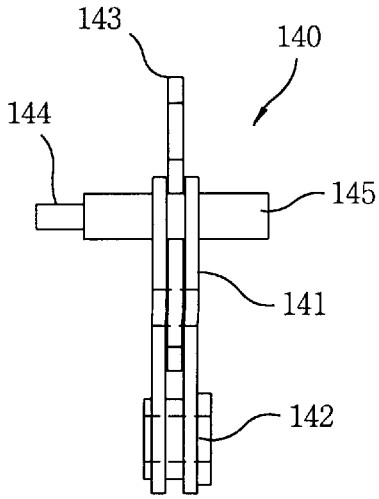
FIG.5B CONVENTIONAL ART
FIG. 5B is a side view illustrating a subordinate driving shaft link unit of the two-position switching actuator according to the conventional art.
Figure 6:
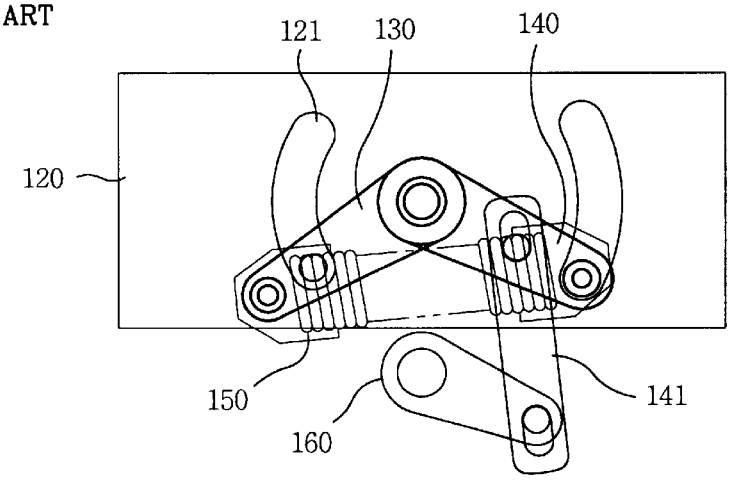
FIG. 6 CONVENTIONAL ART
FIG. 6 is an operational view illustrating a state of the conventional two-position switching actuator when the driving shaft unit and the subordinate driving shaft link unit are positioned in their initial locations.
Figure 7:
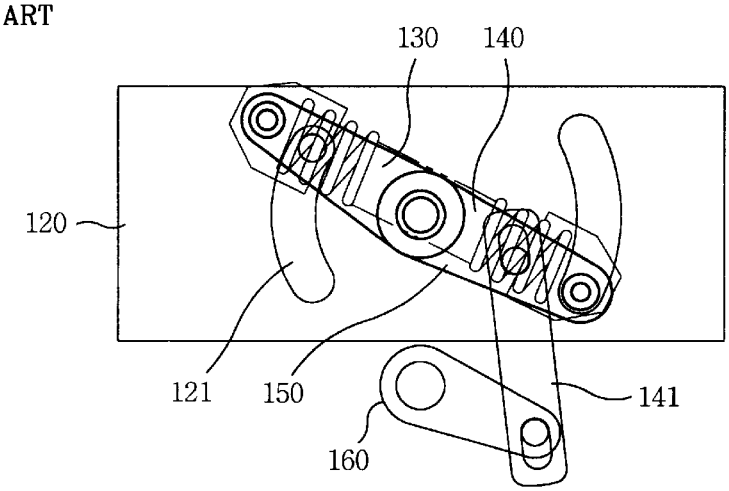
FIG. 7 CONVENTIONAL ART
FIG. 7 is an operational view illustrating a state of the conventional two-position switching actuator when the driving shaft unit is rotatably reached to an end portion in an arc opening formed in a base plate.
Figure 8:
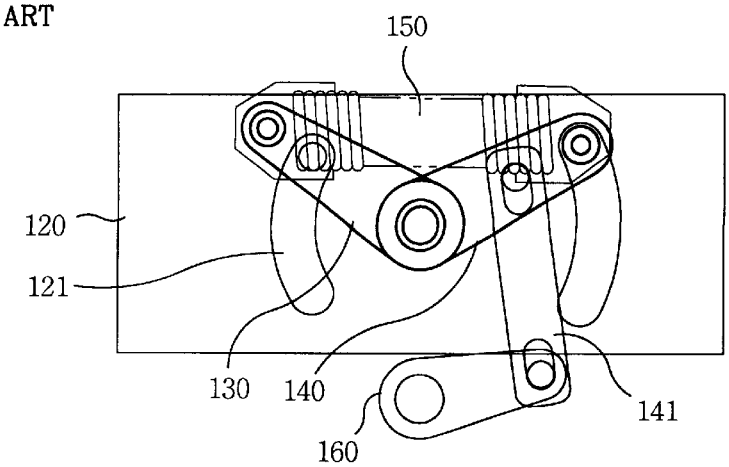
FIG. 8 CONVENTIONAL ART
FIG. 8 is an operational view illustrating a state of the conventional two-position switching actuator when the subordinate driving shaft link unit makes its instant rotation by receiving an elastic restoration force of a spring and a contact point is shifted accordingly.

With reference to the accompanying drawings, the multi-position switching actuator for a switch gear according to the present invention will now be described.

FIGS. 9 through 13 respectively illustrate the multi-position switching actuator for a switch gear with regard to a manual control method according to the present invention. As shown therein, the multi-position switching actuator includes:

a control handle unit 200; a rotation member 400 disposed at a portion spaced from a rear portion of the control handle unit 200 and rotated in accordance with the rotation of the control handle unit 200; a front plate 300 disposed between the control handle unit 200 and the rotation member 400 for thereby limiting the rotation of the control handle unit 200; a latch releasing member 500 fixedly engaged to the rear surface of the rotation member 400 and rotated in correspondence to the rotation member 400; a latch driving member 600 fixedly engaged to the latch releasing member 500 and rotated in correspondence to the rotation of the latch releasing member 500; a location fixing member 700 connected to the latch driving member 600 and limiting the rotation of the latch driving member 600 by a predetermined angle; an elastic member 800 (which is a part of the latch releasing member 500) for biasing rotation of the latch driving member 600; and a central shaft 900 being inserted from the rear portion of the latch driving member 600 toward the front of the multi-position switching actuator.

The control handle unit 200 includes: a lever 230; and a control handle 250 a front surface of which is provided with a protrusion 240 having an insertion hole for receiving the lever 230, and a rear surface of which includes a control protrusion 210 extended from an end portion of the rear surface thereof and an insertion recess 220 formed in a central portion of the rear surface thereof.

The rotation member 400 formed of a rotation disk includes a central protrusion 410 extended from the center of the rotation disk, and at least two control holes 430*a* and 430*b* are punched so what either can receive the control protrusion 210 of the control handle 200 therethrough. Also, a plurality of bolt holes 420 are punched around the central protrusion 410 so as to fixedly engage the rotation member 400 to the latch releasing member 500.

The front plate 300 is in a square type but other shapes or types may be used. A via hole 310 is formed through the center of the front plate 300 in order for the central protrusion 410 of the rotation member 400 to pass therethrough.

Also, arc control openings 320*b* and 320*a* are formed to the left and right of the via hole 310 in order to limit the rotation of the control protrusion 210 of the control handle 200.

The central protrusion 410 extended from the rotation member 400 passes through the via hole 310 formed in the front plate 300 and is inserted into the insertion recess 220 of the control handle 200. The control protrusion 210 of the control handle is inserted through the control hole 430.

The latch releasing member 500 includes: a stable plate 510; a spring support plate 520 extended from a lower portion of the stable plate 510 and bent backwardly by 90 degrees or the like, a spool 530 disposed at a rearward location from the stable plate 510 and having an identical axis to the stable plate 510 for thereby being wound by a spring 800 serving as an elastic member; a latch releasing plate 540 formed vertically at a rearward location from the spool 530; and an engagement pin 550 for engaging the stable plate 510 to the latch releasing plate 540.

The stable plate 510 includes a via hole 511 serving as a circular opening formed in the center thereof, and a plurality of bolt holes 512 are punched outside the periphery of the via hole 511 so that a fixture member or the like for fixing the stable plate 510 to the rotation member 400 can pass therethrough.

Also, an upper portion of the stable plate 510 is rearwardly stepped by 90degrees, and the end portion of the stepped portion is upwardly stepped. An insertion hole 513 is formed through a portion of the upwardly stepped portion for thereby receiving the engagement pin 550 therethrough.

The spool 530 is provided with a via hole 531 formed along the axis of the spool 530, and a plurality of bolt holes 532 are formed in a peripheral rim portion of the spool 530 for thereby allowing fixture members to pass therethrough.

A via hole 541 is formed through the center of the latch releasing plate 540 in order for the center shaft 900 to pass therethrough, and a plurality of bolt holes 542 are formed around the via hole 541. An engagement hole 543 is formed in an upper portion of the latch releasing plate 540 for thereby receiving the engagement pin 550 therethrough.

On each side of the latch releasing plate 540 there is formed a guide opening 544 which has a smaller rotational radius as it runs inwardly.

In the above-constituted latch releasing member 500, the engagement pin 550 is to be inserted through the engagement hole 513 formed in the upper portion stepped upwardly from the stable plate 510 and through the engagement hole 543 formed in the upper portion of the latch releasing plate 540.

The latch driving member 600 includes: a first driving plate, that is, the front driving plate 610; a first spring support plate 620 extended and forwardly stepped by 90 degrees or the like from a lower portion of the front driving plate 610; a second driving plate, that is, a rear driving plate 630 for being fixed via an arrangement including the latch pin 650 to a rear surface of the front driving plate 610; a second spring support plate 640 extended and forwardly stepped by 90 degrees or the like from a lower portion of the rear driving plate 610; a latch 650 disposed between the front driving plate 610 and the rear driving plate 630 for thereby being hooked on a latch roller 730 of a location fixing member 700; a latch pin 660 extended forwardly from an end portion of the latch 650 and being disposed within the guide opening 544 of the latch releasing member 500; and a spring 670 for being inserted onto a rear end portion of the rotation shaft 680 with regard to the latch 650 for thereby allowing the latch 650 to have an elastic restoration force.

The front and rear driving plates 610, 630 are fixedly engaged via an arrangement including the latch pin 650 each to other in a way in which the rear driving plate 630 is correspondingly fitted to the rear surface of the front driving plate 610.

Also, an end portion 800*a* and another end portion 800*b* of the high intensity spring 800 which is to be wound on the spool 530 of the latch releasing member 500 are hooked on the respective end portions of the first and second spring support plate 620, 640 extended and stepped forwardly from the lower portion of the front and rear driving plates 610, 630.

Each the front and rear driving plates 610, 630 becomes wider as it runs upwardly, and respective top ends of the front and rear driving plates 610, 630 are respectively formed in a circular arc type, and via holes 611, 631 are formed through the central portions of the front and rear driving plates 610, 630 for receiving the central shaft 900 therethrough. A plurality of bolt holes 612, 632 are formed outside the via holes 611, 631.

Insertion holes 613, 633 are formed in upper side portions of the front and rear driving plates 610, 630 for thereby allowing the rotation shafts 680 of the latches 650 to be inserted therethrough, and at each side of the front and rear driving plates 610, 630 there are also provided pin hooking wings 614, 634 for hooking the latch pins 660 thereon.

The location fixing member 700 includes: a base plate 710 having a via hole 711 formed through the center thereof for thereby allowing the central shaft 900 to pass therethrough and having a plurality of bolt holes 712 formed outside the via hole 711; a plurality of latch roller stable shafts 720 spaced from each other in a circular arc type or in other configurations with regard to the base plate 710; a plurality of latch rollers 730 for being fixed onto corresponding ones of the latch roller stable shafts 720; and a C-type latch roller stable plate 740 for serving to link respective end portions of the latch roller stable shafts 720 therewith in.

An end portion of each of the latch roller stable shafts 720 is inserted into a corresponding one of the latch rollers 730, and another end portion thereof is inserted into a corresponding one of the bolt holes 712 formed in the base plate 710. The latch roller stable shafts 720 are fixed by bolts 750. At the middle portion of each of the latch roller stable shafts 720 there is provided a bush 720*a* serving to limit the insertion of the latch rollers 730.

A plurality of insertion holes 741 are formed along the latch roller stable plate 740 for thereby receiving respective end portions of the latch roller stable shafts 720.

The operational steps of the above composed multi-position switching actuator for a switch gear according to the present invention will now be explained.

Figure 9:
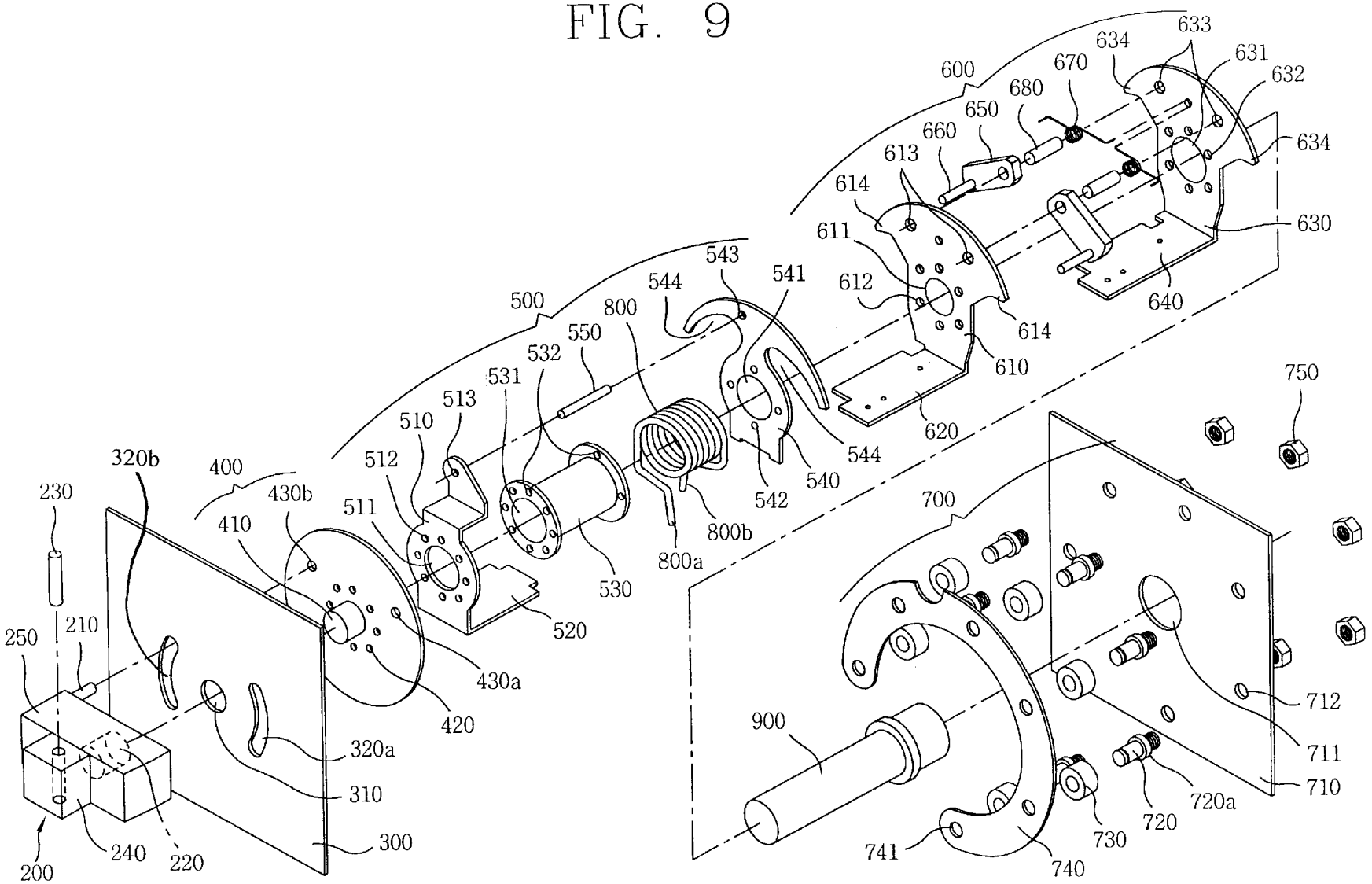
FIG. 9 is an exploded perspective view of a multi-position switching actuator for a switch gear according to the present invention.
Figure 10:
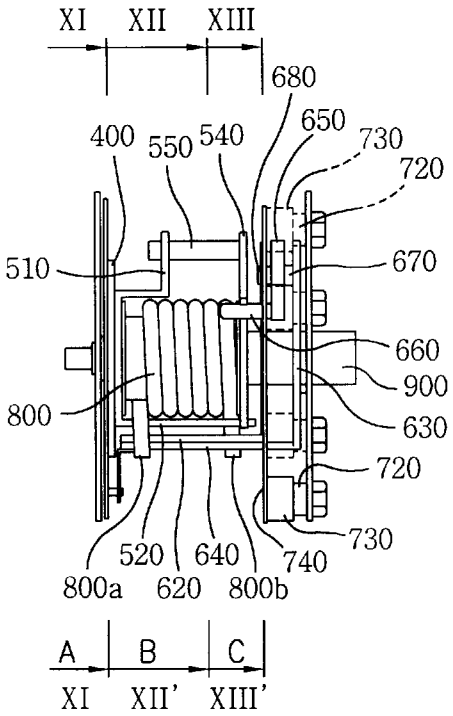
FIG. 10 is a side view of a multi-position switching actuator for a switch gear according to the present invention.
Figure 11:
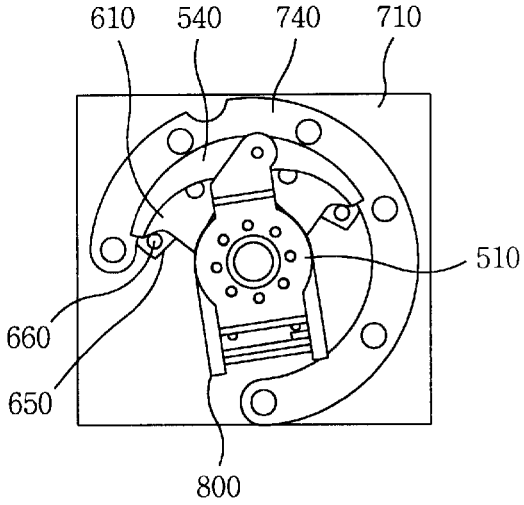
FIG. 11 is a cross-sectional view taken along line XI–XI' in FIG. 10 for illustrating an internal composition of the multi-position switching actuator for a switch gear according to the present invention.
Figure 12:
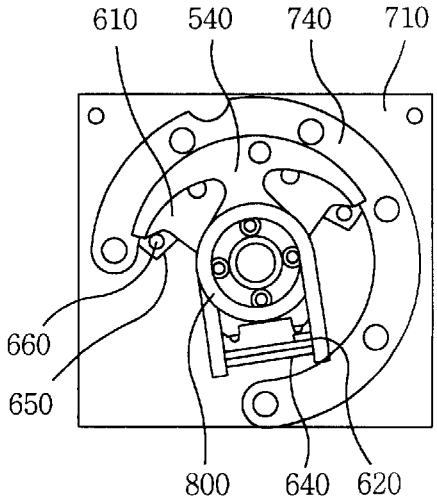
FIG. 12 is a cross-sectional view taken along line XII–XII' in FIG. 10 for illustrating an internal composition of the multi-position switching actuator for a switch gear according to the present invention.
Figure 13:
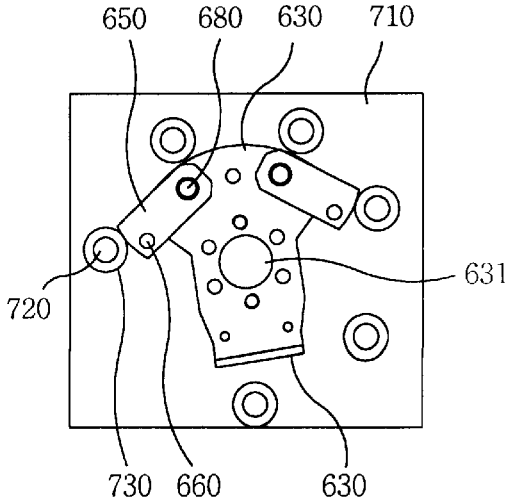
FIG. 13 is a cross-sectional view taken along line XIII–XIII' in FIG. 10 for illustrating an internal composition of the multi-position switching actuator for a switch gear according to the present invention.

As shown in FIG. 9, the control protrusion 210 extended from a side rear surface portion of the control handle unit 200 is inserted through the left side arc control opening 320*b* formed in the front plate 300 into the control hole 430*b* formed in the rotation disk 400, and at the same time the insertion recess 220 formed in a central rear surface portion of the control handle unit 200 comes to receive therein the central protrusion 410 extended forwardly from the rotation disk 400, thereby rotating the control handle unit 200 along the arc type control openings 320 formed in the front plate 300.

When the control handle unit 200 is rotatecl, the rotation force from the control handle unit 200 is transferred to the rotation disk 400 engaged by the control protrusion 210 to the control handle unit 200 and serves to rotate the rotation disk 400.

According to the rotation of the rotation disk 400, the stable plate 510 engaged to the rotation disk 400 is also rotated.

At this time, the stable plate 510, the spring Support plate 520 and the latch releasing plate 540 are fixedly engaged to each other by fixture members such as bolts and nuts or the like, for thereby being rotated in correspondence to the rotation the rotation disk 400.

Figure 14:
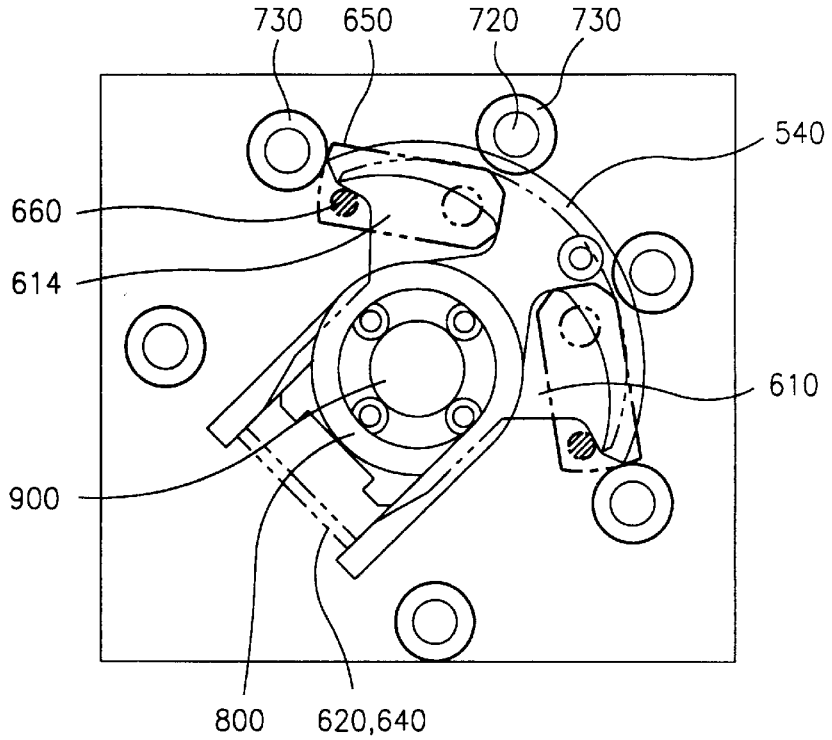
FIG. 14 is an operational view illustrating a state in which the multi-position switching actuator according to the present invention is in its initial location.
Figure 15:
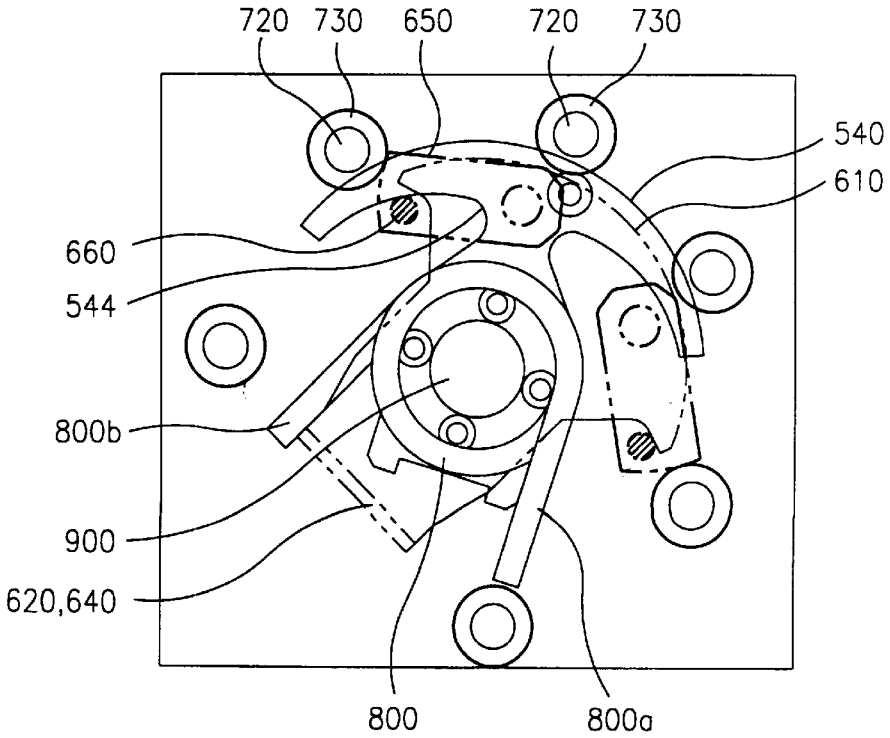
FIG. 15 is an operational view illustrating a state in which the multi-position switching actuator according to the present invention makes its operation and a latch pin begins to be hooked in a guide opening formed in a latch releasing plate.

When the stable plate 510 fixed to the rotation disk 400 makes it rotation, as shown in FIGS. 14 and 15, the elastic restoration force of the spring 800 is applied to the first and second spring support plates 620 and 640 which are abutted by the end 800*b* of the spring 800. And then, although the spring support plate 520 further rotates, the plates 620 and 640 will not continue to rotate since the latch 650 abuts the latch roller 730, thus the spring 800 is biased as shown in FIG. 15.

When the spring support plate 520 makes its rotation together with the end portion 800*a* of the spring 800, the latch releasing plate 540 engaged to the spring support plate 520 is also rotated accordingly.

Figure 16:
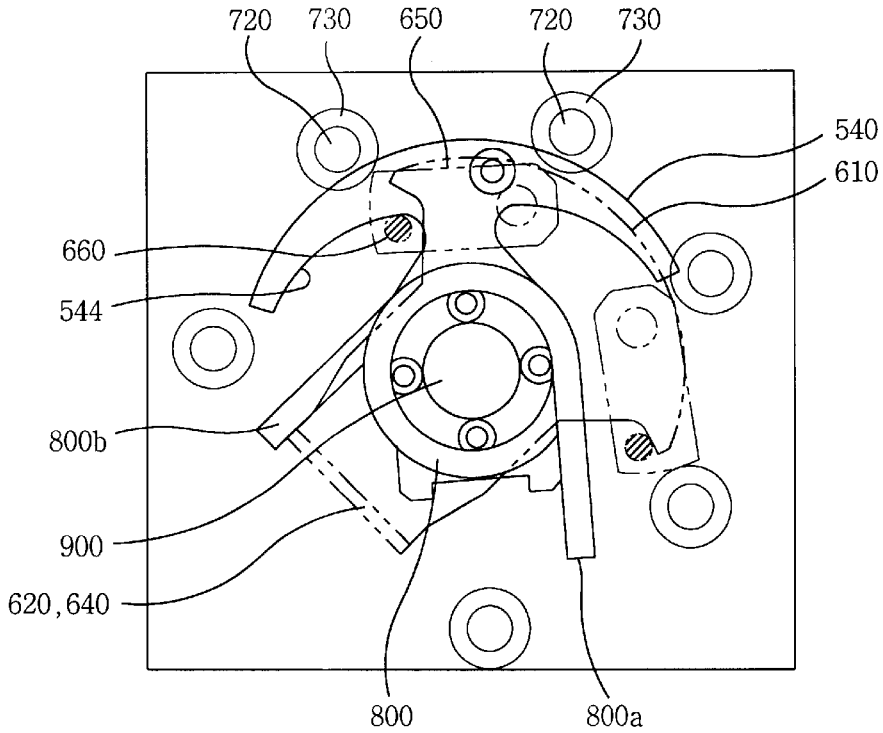
FIG. 16 is an operational view illustrating a state in which the multi-position switching actuator according to the present invention makes its operation and the latch pin begins to be downwardly pressed by the guide opening formed in a latch releasing plate.

As shown in FIG. 16, when the latch releasing plate 540 makes its rotation, each of the guide openings 544 formed in the side portions of the latch releasing plate 540 is also rotated, so that the latch pin 660 of the latch 650 that moves within the guide recess 544 becomes pressed.

Specifically, when the latch releasing plate 540 makes its rotation, the latch pin 660 disposed at an entrance to the guide opening 544 moves toward an interior of the guide opening 544.

At this time, a rotational radius of the guide opening 544 becomes smaller toward its interior, and accordingly when the rotation of the latch releasing plate 540 continues in the same direction, the latch pin 660 gradually moves to a downward direction in accordance with the guide opening 544.

Likewise, when the latch pin 660 makes its downward movement, the latch 650 is downwardly pressed in proportion thereto, thereby rotating downwardly while having the rotation shaft 680 as its rotation axis. When the latch releasing plate 544 makes its rotation by a predetermined angle in accordance with the continuous rotation of the latch releasing plate 544, the latch 650 becomes released from the latch roller 730.

Figure 17:
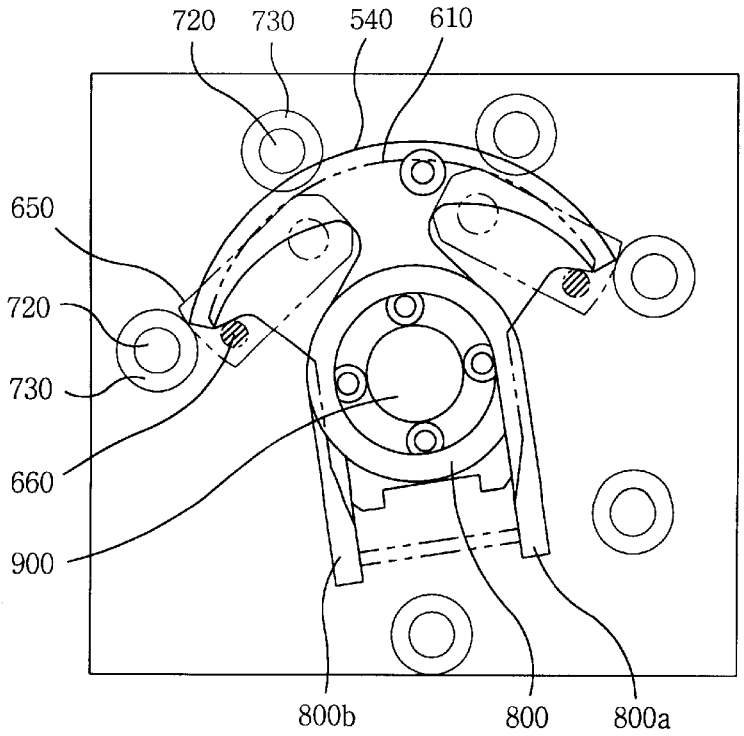
FIG. 17 is an operational view illustrating a state in which front and rear driving plates of the multi-position switching actuator according to the present invention are rotated in accordance with an elastic restoration force of a spring for thereby switching contact points.

As shown in FIG. 17, the moment the latch 650 is released from the latch roller 730, the front and rear driving plates 610, 630 make their instant rotations in correspondence to the elastic restoration force of the spring 800 which is pressed by the first and second spring support plates 620, 640.

Therefore, when the front and rear driving plates 610, 630 make their rotations, the central shaft 900 fixed thereto (e.g., by a weld) is rotated, and accordingly an internal contact within the switch gear according to the present invention becomes shifted to another desired contact.

The shifting of a contact to another becomes possible by installing the latch roller stable shafts 720 and the latch rollers 730 which are hooked by the latch 650.

Its reverse operational steps may be carried out in reverse order and therefore its relevant description will be omitted.

As described above, the multi-position switching actuator for a switch gear according to the present invention employs a single actuator to enable a contact to switch to another contact position, thereby simplifying production and minimizing parts required in size as well as decreasing production cost.

As the present invention may be embodied in several forms without departing from the spirit of essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. A multi-position switching actuator for a switch gear, comprising:

a control handle unit to rotatably transfer a first rotational force of the switching actuator;

a rotation unit coupled to the control handle unit to transfer said first rotational force;

a front plate disposed between the control handle unit and the rotation unit for limiting a range of rotation of the control handle unit; a latch releasing unit coupled to the rotation unit so as to be rotated in correspondence to the rotation unit;

a latch driving unit coupled to the latch releasing unit;

a latch stopping unit coupled to the latch unit and arranged to limit rotation of the latch unit to a predetermined angular range;

an elastic unit disposed between the latch releasing unit and the latch unit to exert a second rotational force on the latch unit that opposes said first rotational force; and a central shaft inserted through the latch unit.

2. The actuator of claim 1, wherein the rotation unit includes a rotation disk.

3. The actuator of claim 2, wherein the rotation disk includes a central protrusion extending from a center of the rotation disk and at least two control holes to receive the control handle unit.

4. The actuator of claim 1, wherein the elastic unit includes hook end portions so as to engage the latch releasing unit and the latch unit.

5. The actuator of claim 1, wherein the control handle unit is operated manually.

6. The actuator of claim 1, wherein the control handle unit includes a protrusion extending from a rear side surface of the control handle unit and an insertion recess formed in a central rear surface of the control handle unit.

7. The actuator of claim 6, wherein the front plate includes a via hole formed through a center of the front plate, and an arcuate opening formed through the front plate so as to limit a rotation of the protrusion extending from the rear surface of the control handle unit.

8. The actuator of claim 1, wherein the latch stopping unit comprises:

a base plate having a via hole formed through a center of the base plate for allowing the central shaft to pass therethrough;

a plurality of latch roller stable shafts, each latch roller stable shaft having an end mounted to the base plate, locations of the latch roller stable shafts being distributed round the via hole of the base plate;

a plurality of latch rollers, one latch roller coupled each latch roller stable shaft, respectively; and a latch roller stable plate for coupling respective end portions of the latch roller stable shafts.

9. The actuator of claim 8, wherein an end portion of each of the latch roller stable shafts is inserted into a corresponding one of the latch rollers, another end portion of each latch roller stable shaft is inserted into a corresponding one of bolt holes formed in the base plate, each of the latch roller stable shafts being threaded for engaging the base plate, and a middle portion of each of the latch roller stable shafts is provided with a bushing serving to limit the insertion of the latch rollers.

10. The actuator of claim 8, wherein a plurality of insertion holes are formed along the latch roller stable plate for receiving respective end portions of the latch roller stable shafts.

11. The actuator of claim 8, when the latch roller stable plate has a C-shaped configuration.

12. The actuator of claim 1, wherein the latch releasing unit is fixedly engaged to a rear surface of the rotation unit.

13. The actuator of claim 12, wherein the latch releasing unit comprises:

a stable plate including a via hole formed through a center of the stable plate for receiving the central shaft;

a spring support plate extended from a lower portion of the stable plate; and a spool disposed at a rearward location from the stable plate and having an identical axis with an axis of the stable plate around which the elastic unit is wound.

14. The actuator of claim 13, wherein an upper portion of the stable plate has a rearwardly stepped portion, an end portion of the stepped portion is upwardly stepped, and an insertion hole is formed through a portion of the upwardly stepped portion for thereby receiving an engagement pin therethrough.

15. The actuator of claim 13, wherein the latch releasing unit further comprises:

a latch releasing plate formed vertically at a rearward location from the spool; and an engagement pin for engaging the stable plate to the latch releasing plate.

16. The actuator of claim 15, wherein the latch releasing plate includes a via hole formed through a center of the latch releasing plate, and a guide opening formed in each upper side portion of the latch releasing plate for receiving a latch pin, respectively.

17. The actuator of claim 16, wherein the guide opening has a gradually decreasing radius.

18. The actuator of claim 17, wherein the latch unit comprises:

a first driving plate;

a first spring support plate extended and forwardly stepped from a lower portion of the first driving plate;

a second driving plate for being fixed to a rear surface of the first driving plate; and a second spring support plate extended and forwardly stepped from a lower portion of the second driving plate.

19. The actuator of claim 18, wherein a latch pin is forwardly extended from a portion of a front surface of a latch, and an insertion hole is formed in another portion of the front surface of the latch for receiving a rotation shaft therethrough.

20. The actuator of claim 18, wherein the latch unit further comprises:

a latch disposed between the first driving plate and the second driving plate for being hooked on a latch roller of the latch stopping unit;

a rotational shaft, inserted into a portion of the latch, for allowing the latch to rotate when the latch is downwardly pressed by the latch releasing plate; and a spring insertable into a rear end portion of the rotation shaft to provide elastic restoration force to the latch.

21. The actuator of claim 20, wherein each of the first and second driving plates includes a via hole for receiving the central shaft therethrough, an insertion hole formed in an upper side portion of each of the first and second driving plates for receiving a rotational shaft of the latch therethrough, and a pin hooking wing formed at each side end portion of the first and second driving plates for being hooked by a latch pin.

* * * * *